US012158323B2

(12) United States Patent
Pearson

(10) Patent No.: US 12,158,323 B2
(45) Date of Patent: Dec. 3, 2024

(54) UNDERWEAR INCLUDING POCKETS FOR PADDING ELEMENTS

(71) Applicant: David Pearson, Greer, SC (US)

(72) Inventor: David Pearson, Greer, SC (US)

(73) Assignee: Gunder LLC, Greer, SC (US)

( * ) Notice: Subject to any disclaimer, the term of this patent is extended or adjusted under 35 U.S.C. 154(b) by 85 days.

(21) Appl. No.: 17/896,592

(22) Filed: Aug. 26, 2022

(65) Prior Publication Data

US 2024/0068773 A1 Feb. 29, 2024

(51) Int. Cl.

| | |
|---|---|
| ***F41C 3/04*** | (2006.01) |
| ***A41B 9/00*** | (2006.01) |
| ***F41C 33/02*** | (2006.01) |
| ***F41C 33/04*** | (2006.01) |

(52) U.S. Cl.

CPC ..... *F41C 33/048* (2013.01); *A41B 9/001* (2013.01); *F41C 33/0209* (2013.01)

(58) Field of Classification Search

CPC ..... A41D 13/0575; A41D 13/0012; A41D 13/0506; A41D 13/0525; A41D 13/0015; A41D 1/06; A41D 1/08; A41D 1/082; A41D 1/084; A41D 1/089; F41C 33/048; F41C 33/0209; F41C 33/0218; F41C 33/008; F41C 33/0236; F41C 33/041; F41C 33/046; A41B 9/001; A41B 9/02; A41B 9/12; A41B 9/004; A41B 9/008; A41B 9/04; A41B 9/08; A41B 9/14; A41B 9/00

USPC ..... 2/464–467

See application file for complete search history.

(56) References Cited

U.S. PATENT DOCUMENTS 3,909,847 A * 10/1975 Holt ..... A41D 1/088 2/466
5,134,726 A * 8/1992 Ross ..... A41D 13/065 2/24
5,497,511 A * 3/1996 Zade ..... A41D 13/0506 2/22
5,636,377 A * 6/1997 Wiener ..... A41D 13/1254 2/2.5
5,689,836 A * 11/1997 Fee ..... A41D 13/0593 2/22
6,076,195 A * 6/2000 Klein ..... A41B 9/023 2/403

(Continued)

*Primary Examiner* — Amy Vanatta
(74) *Attorney, Agent, or Firm* — Rutan & Tucker, LLP; Kyle M. St. James

(57) ABSTRACT

Disclosed herein is underwear facilitating comfortable carrying of a concealed firearm. The underwear includes a number of pouches strategically located adjacent carrying locations of the firearm, where the pouches may selectively contain a removeable pad. The underwear includes a pouch at each side of the users hips and a pouch at the groin area. Each pouch includes a top opening having a closure mechanism. The user may place a pad within the pouch adjacent the carrying location of the firearm. The underwear includes an outer fabric layer configured to prevent wear-out due to contact with the firearm or holster and inner fabric layer configured for skin contact. Removable pads may be provided in different shapes, thicknesses, levels of firmness, etc. Shapes may correspond to body anatomy or firearm/holster shape. The pads may be removed from the pouches so that the underwear may be worn while not carrying the firearm.

15 Claims, 4 Drawing Sheets

(56) References Cited

U.S. PATENT DOCUMENTS

| | | | | |
|---|---|---|---|---|
| 6,093,468 | A * | 7/2000 | Toms | A41D 31/14 2/22 |
| 9,513,084 | B1 * | 12/2016 | Baugh | F41C 33/0209 |
| 2003/0051288 | A1 * | 3/2003 | Dugan | A41D 13/0543 2/228 |
| 2005/0203454 | A1 * | 9/2005 | Wiener | A41D 13/0506 602/23 |
| 2007/0250980 | A1 * | 11/2007 | Pellerin | F41C 33/0209 224/587 |
| 2010/0024104 | A1 * | 2/2010 | Sims | A63B 71/1216 2/466 |
| 2010/0050312 | A1 * | 3/2010 | French | A41D 1/00 2/250 |
| 2012/0023645 | A1 * | 2/2012 | Murphy | A41B 9/12 2/400 |
| 2015/0196070 | A1 * | 7/2015 | Burger | A41D 13/0506 2/465 |
| 2015/0359273 | A1 * | 12/2015 | Olson | A41D 13/0012 2/250 |
| 2016/0073705 | A1 * | 3/2016 | DeLaRosa | A41D 1/089 2/228 |
| 2020/0068968 | A1 * | 3/2020 | Robinson | A41D 1/08 |

* cited by examiner 100
102
221
10
222
20
150A
31
40
110A
5
30
106

UNDERWEAR INCLUDING POCKETS FOR PADDING ELEMENTS

BACKGROUND

Carrying a firearm in a concealed fashion during normal activities is becoming more common. In some cases, it is advantageous to have the firearm located in close proximity to the user's hand such as adjacent the waist of the user. Handgun holsters secured to a belt or a trouser waistband provide for securement of the firearm near the waist. In some cases, the firearm is secured inside the trouser waistband, such as between the belt and user's underwear. However, firearms carried in this fashion may cause discomfort, irritation and in some cases injury to the user, such as skin abrasion or bruising, for example. Disclosed herein are clothing garments, e.g., underwear, that addresses the forgoing.

SUMMARY

Embodiments disclosed herein include an underwear for use with carrying a concealed firearm. The underwear includes one or more fabric layers defining (i) a hip portion, the hip portion including a right side and a left side, (ii) a waistband disposed at a top of the hip portion, (iii) a right legging and a left legging extending downward from the hip portion, and (iv) a groin area extending across a front side of the hip portion. The underwear further includes a right side pouch extending across the right side, a left side pouch extending across the left side, and a groin pouch extending across the groin area.

In some embodiments, each of the right side, left side, and groin pouches are formed by an outside fabric layer coupled with an inside fabric layer via a sewn seam defining a perimeter extending along a bottom edge and opposite side edges of each of the right side, left side, and groin pouches.

In some embodiments, the perimeter of each of the right side and left side pouches includes a straight front side edge and curved back side edge.

In some embodiments, a top side of one or more of the right side, left side, and groin pouches includes a closure mechanism having one or more of a single ended zipper, a double ended zipper, a hook and loop fastening system, a button, a snap, or an overlapping fabric layer.

In some embodiments, the underwear further includes a right pad configured for placement within the right side pouch, a left pad configured for placement within the left side pouch, and a groin pad configured for placement within the groin pouch.

In some embodiments, during use, the underwear includes at least one of (i) the right pad disposed within the right side pouch, (ii) the left pad disposed within the left side pouch, or (iii) the groin pad disposed within the groin pouch.

In some embodiments, during use, the underwear includes at least one of (i) more than one right pad disposed within the right side pouch, (ii) more than one left pad disposed within the left side pouch, or (iii) more than one groin pad disposed within the groin pouch.

In some embodiments, during use, the underwear includes at least two of (i) the right pad disposed within the right side pouch, (ii) the left pad disposed within the left side pouch, or (iii) the groin pad disposed within the groin pouch.

In some embodiments, each of the right pad, the left pad, and the groin pad are flexible in bending so that the right pad, left pad, or groin pad bend in accordance with motion of the user.

In some embodiments, one or more of the right pad, the left pad, or the groin pad include a preformed body engagement shape to correspond to a body anatomy of the user.

In some embodiments, one or more of the right pad, the left pad, or the groin pad include a preformed firearm engagement shape to correspond to a shape of at least one of a firearm or a holster.

In some embodiments, the preformed firearm engagement shape includes one or more of depressions or protrusions disposed across an outside surface of the one or more of the right pad, the left pad, or the groin pad.

In some embodiments, the right and left pads are mirror images of each other.

In some embodiments, one or more the right pad, the left pad, or the groin pad include a memory foam.

In some embodiments, the one or more fabric layers include (i) an interior fabric layer composed of a moisture wicking material and (ii) an exterior fabric layer composed of an abrasion resistant material.

Also disclosed herein is a method of carrying a concealed firearm, where the method include (i) choosing a placement location from three potential concealment locations for carrying a firearm, (ii) placing a pad within a pouch of an underwear, the pouch positioned adjacent the placement location, (iii) donning the underwear, and securing the firearm adjacent the pouch (e.g., where the firearm is secured to a belt or a trouser waistband).

In some embodiments, the pouch is one of three pouches, each pouch positioned adjacent a different one of the three potential concealment locations.

In some embodiments, the method further includes choosing the pad from a number of optional pads, each optional pad having a thickness different from the other optional pads.

In some embodiments, the pad includes a shape defined in accordance with the placement location, where the shape is different from shapes defined in accordance with the other concealment locations, and the pouch includes a shape matching the shape of the pad.

In some embodiments, the pad includes a curved shape defined in accordance with a body anatomy.

These and other features of the concepts provided herein will become more apparent to those of skill in the art in view of the accompanying drawings and following description, which describe particular embodiments of such concepts in greater detail.

BRIEF DESCRIPTION OF THE DRAWINGS

Illustrative examples are described in detail below with reference to the following figures.

DETAILED DESCRIPTION

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

Unless defined otherwise, all technical and scientific terms used herein have the same meaning as commonly understood by those of ordinary skill in the art.

Figure 1:
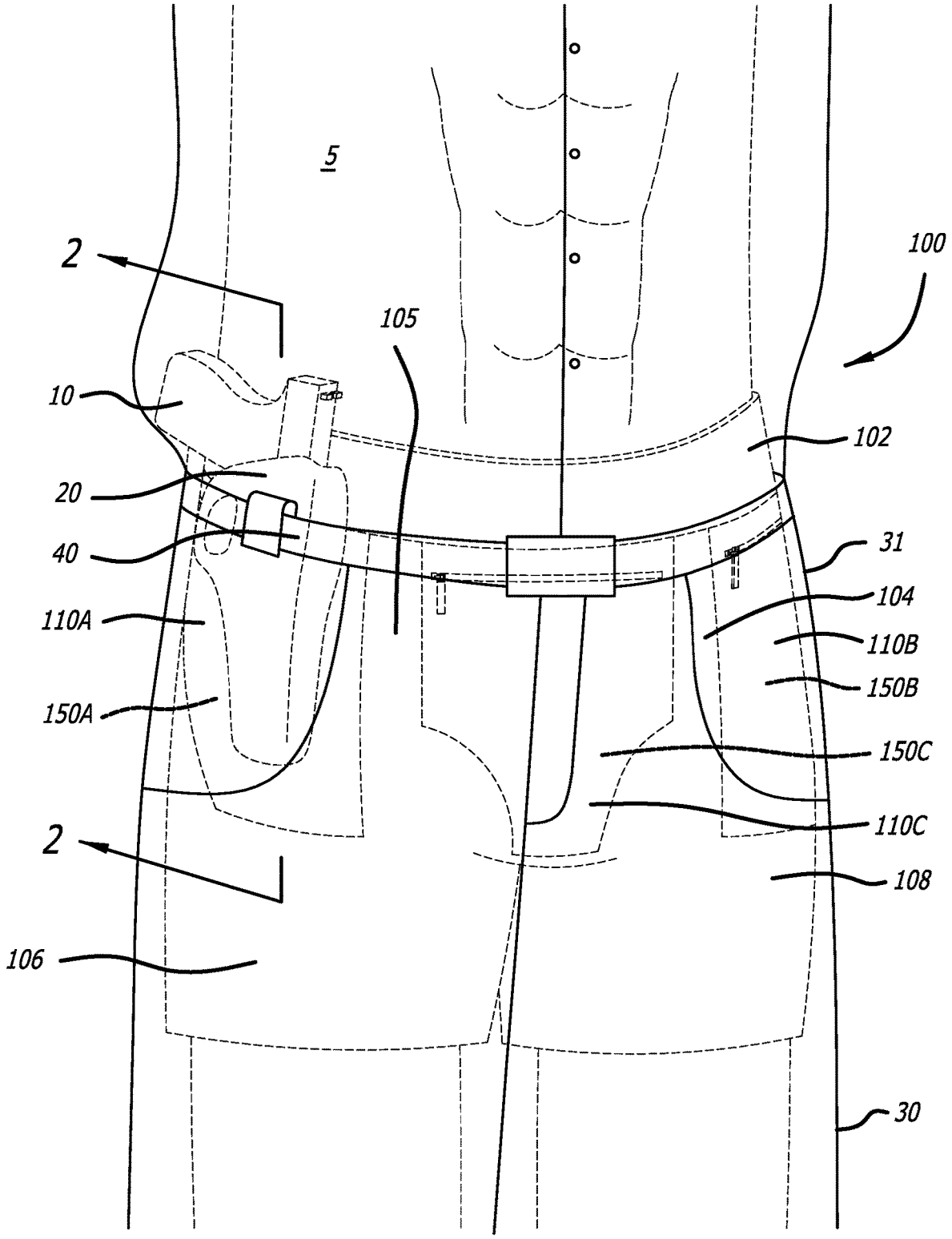
FIG. 1 illustrates an underwear worn by a user carrying concealed firearm inside a trouser waistband, in accordance with some embodiments.

FIG. 1 illustrates a front view of an underwear (e.g., underpants) 100 as donned (worn) by a user 5. The underwear 100 is generally configured to facilitate carrying a firearm 10 in a concealed fashion. In some instances, the firearm 10 may be secured with a holster 20. During use, the firearm 10 may be placed (i) at a right side location of the user 5 (adjacent the right side of the user's hip), (ii) at a left side location of the user 5 (adjacent the left side of the user's hip), or (iii) at a groin location of the user 5. In some instances, the user 5 may carry more than one firearm 5. In some instances, the firearm 10 may be placed inside the trousers 30 of the user 5 such as inside a trouser waistband 31. In some embodiments, the firearm 10 may be inside a belt 40 of the user 5. In other instances, the firearm 10 may be placed outside the trousers 30 of the user 5. In some embodiments, the holster 20 may secured to the trouser waistband 31 and/or the belt 40. The underwear 100 is generally configured to be worn underneath the trousers 30 of the user 5.

The underwear 100 generally includes a waistband 102, a hip portion 104, front area 105, a right legging 106, and a left legging 108. The underwear 100 is generally configured to reduce the discomfort of carrying the firearm 10. In some instances, the user 5 may carry the firearm 5 for long periods of time. The user 5 may also carry the firearm 5 and while standing, sitting, walking, and the like. The underwear 100 may generally soften the contact between the firearm 10 and the user 5, i.e., reduce the pressure points between the between the firearm 10 and the user 5. As such, the underwear 100 provides for the placement of padding between the firearm 10 and the user 5.

The underwear 100 may facilitate the placement of padding between the firearm 10 and the user 5 when the firearm 10 is placed adjacent a right side, a left side or a groin area of the user 5. In the illustrated embodiment, the underwear 100 includes three pouches. In other embodiments, the underwear 100 may include more or less than three pouches. The underwear 100 includes a right side pouch 110A configured for placement of a right pad 150A therein. The right side pouch 110A is located so that the right pad 150A is disposed between the firearm 10 (or a portion thereof) and user 5 when the firearm 10 is placed adjacent the right side of the user 5. The underwear 100 further includes a left side pouch 110B configured for placement of a left pad 150A therein. The left side pouch 110B is located so that the left pad 150B is disposed between the firearm 10 (or a portion thereof) and user 5 when the firearm 10 is placed adjacent the left side of the user 5. The underwear 100 further includes a groin pouch 110C configured for placement of a groin pad 150C therein. The groin pouch 110C is located so that the groin pad 150C is disposed between the firearm 10 (or a portion thereof) and user 5 when the firearm 10 is placed adjacent the groin area the user 5. Each of the pouches 110A-110C may be configured to receive more than one of the pads 150A-150C, respectively. The pouches 110A-110C are configured to facilitate placement and removal of the pads 150A-150C into and from the pouches 110A-110C, respectively.

During use, any or all of the pads 150A-150C may be omitted from the pouches 110A-110C, respectively. For example, in some instances, the user 5 may carry one firearm 10 at any of the right side, left side or groin locations. In other instances, the user 5 may carry two firearms 10 at any two of the right side, left side or groin locations. In other instances, the user 5 may carry three firearms 10 at all three of the right side, left side or groin locations. In other instances, the user may omit caring the firearm 10 altogether. In each of instances above, the user 5 may place a pad within its respective pouch when the firearm 10 is carried at the respective location. Similarly, in each of instances above, the user 5 may remove a pad from its respective pouch or omit placing the pad in its respective pouch when the firearm 10 is not carried at the respective location. To be clear, the underwear 100 may be worn by the user 5 without any of the pads 150A-150C disposed within the pouches 110A-110C.

Figure 2:
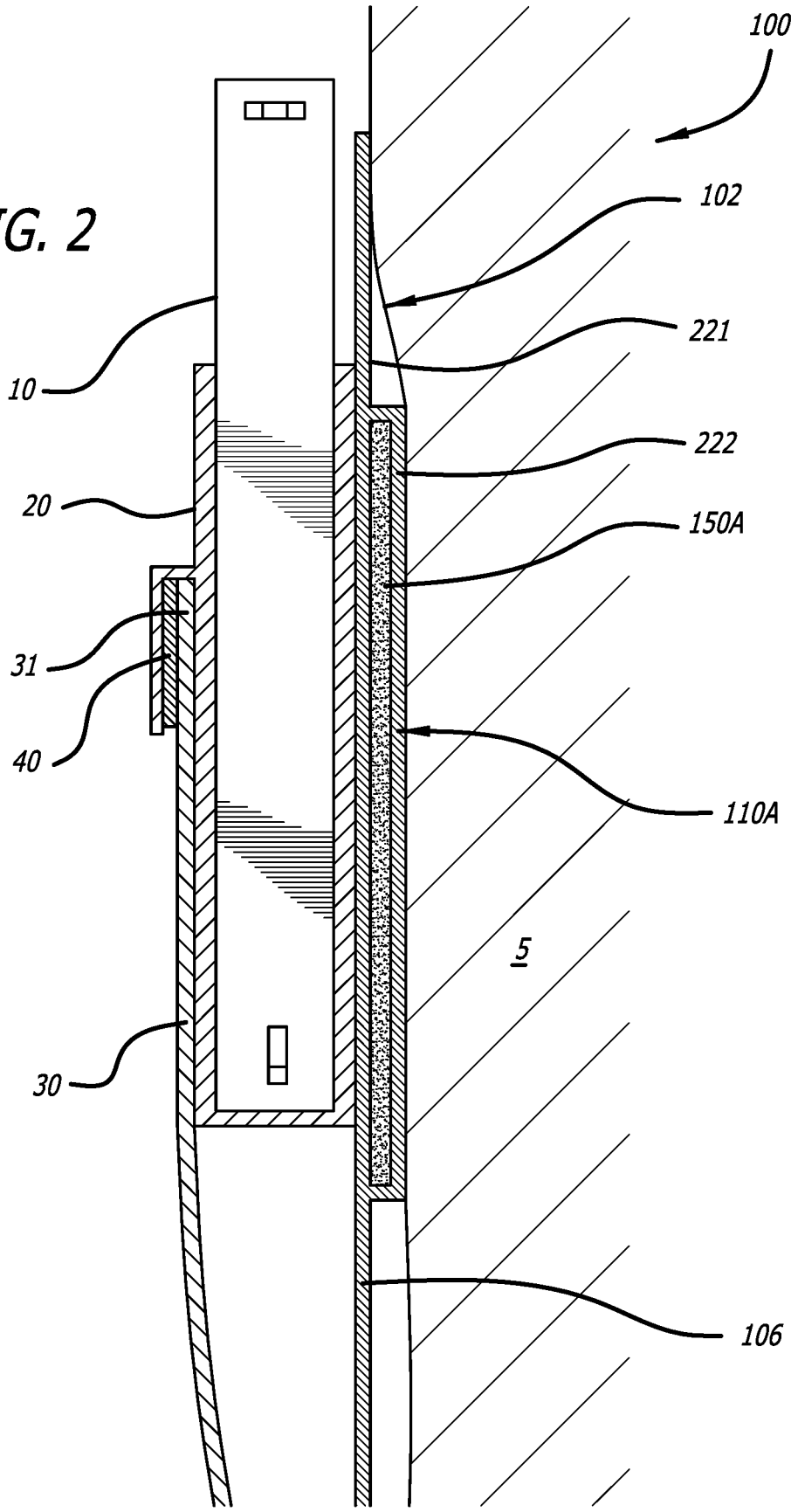
FIG. 2 illustrates a detailed cross-sectional view of a right side portion of the underwear of FIG. 1, in accordance with some embodiments.

FIG. 2 illustrates a detailed cross-sectional view of a right side portion of the underwear 100 as indicated by the cut lines 2-2 of FIG. 1. Many of the details described in connection with the right side portion of the underwear may apply equally well to the left side portion and/or the front area of the underwear 100. FIG. 2 shows the firearm 10 secured within the holster 20 with the holster 20 secured to the trouser waistband 31 and the belt 40. Shown also is the right side pouch 110A having the right pad 150A disposed therein.

The underwear 100 includes a first (or outer) fabric layer 221 which may, in some embodiments, define an exterior of the underwear 100. As such, the first fabric layer 221 may be placed in contact with the firearm 10 and/or the holster 20. The first fabric layer 221 may also contact the inside surface of the trousers 30. The first fabric layer 221 may be disposed between the firearm 10 or the holster 20 and the right pad 150A. In some embodiments, the first fabric layer 221 may generally define the waistband 102, the hip portion 104, the front area 105, the right legging 106, and the left legging 108. As the first fabric layer 221 may rub on the firearm 10 and/or the holster 20 during use, the first fabric layer 221 may be formed of a first fabric material that is generally configured to resist abrasion, i.e., not wear out, according to some embodiments. Exemplary abrasion resistant fabric materials may include fabrics marketed as KEVLAR®, or CORDURA®.

In some embodiments, the underwear 100 may include a second fabric layer 222 disposed inside of the first fabric layer 221. In some embodiments, the right side pouch 110A may be defined by the space between the first fabric layer 221 and the second fabric layer 222. As such, the second fabric layer 222 may be disposed between the first pad 150A and the user's skin. As such, the second fabric layer 222 may be formed of a second fabric material configured for skin contact so as to resist abrasion/irritation of the skin during use. In some embodiments, the second fabric layer 222 may extend across an entire inside surface of the first fabric layer 221 so as to prevent contact of the first fabric layer 221 and the skin. Said another way, the second fabric layer 222 may define a liner of the underwear 100. In some embodiments, the second fabric material may include a moisture wicking material. Exemplary materials for the second fabric may include lycra, cotton, spandex, nylon, polyester, polypropylene, wool, or any combination thereof. In some embodiments, the second fabric layer 222 may generally define the waistband 102, the hip portion 104, the front area 105, the right legging 106, and the left legging 108. In such embodiments, the first fabric layer 221 may simply define an outer layer of the pouch 110A.

Figure 3:
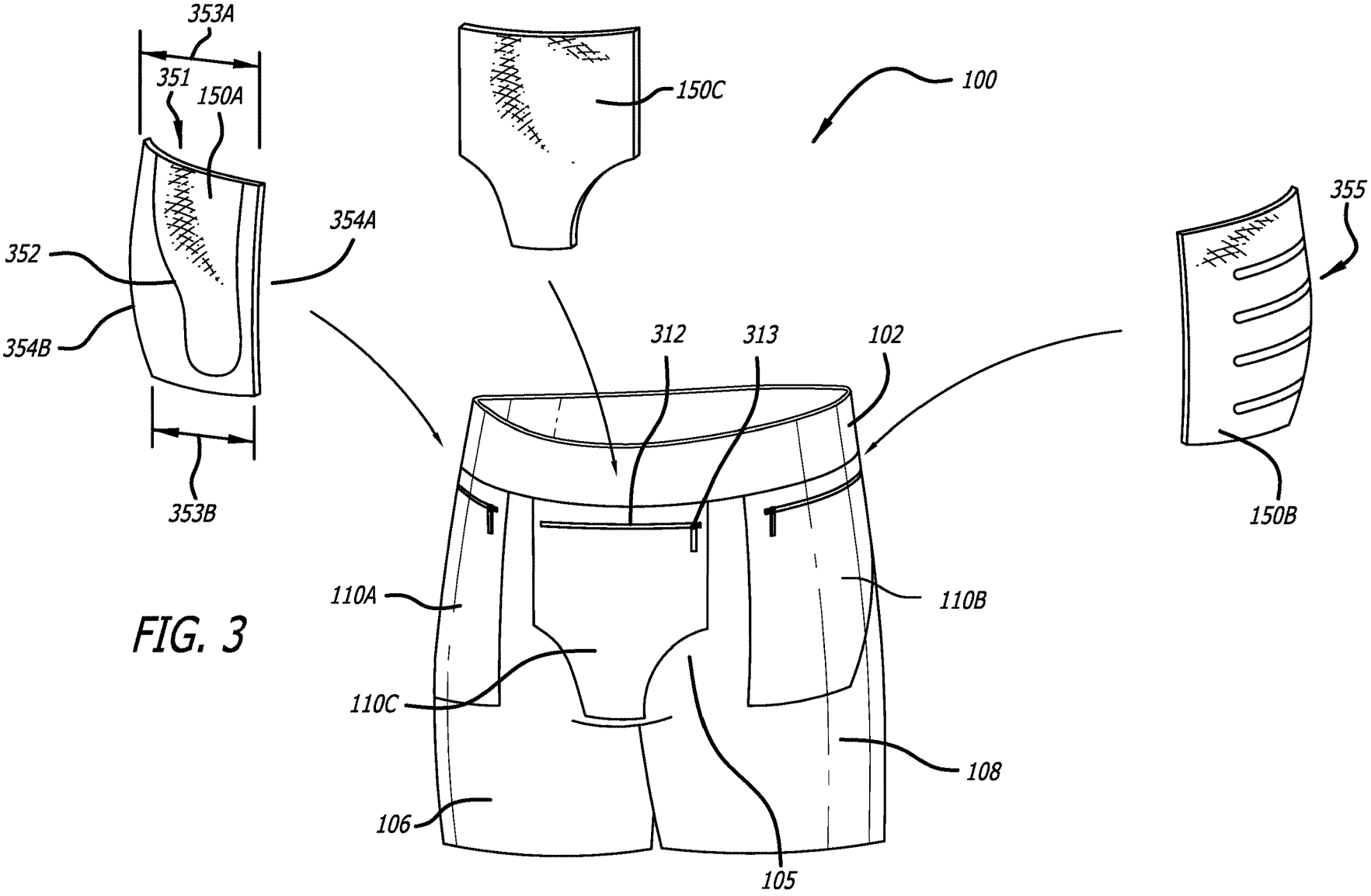
FIG. 3 illustrates an exploded view of the underwear of FIG. 1 including the pads removed from the pouches, in accordance with some embodiments.

FIG. 3 illustrates an exploded view of the underwear 100, where the pads 150A-150C are removed from the pouches 110A-110C. Each of the pads 150A-150C may include shapes that enhance comfort for the user 5. The features of the right pad 150A as shown and described below may also apply the left pad 150B and the groin pad 150C. The right pad 150A may include a body engagement shape or curve 351 which may correspond to an anatomy of the user.

The right pad 150A may include a firearm engagement shape 352 that generally configured to match or otherwise correspond to the shape of the firearm 10 or the holster 20. The firearm engagement shape 352 may inhibit motion or movement of the firearm 10 with respect to the underwear 100 during use. The firearm engagement shape 352 may include depressions and/or protrusion along an outside surface of the right pad 150A. In some embodiments, the right pad 150A may include a top width 353A that is greater than a bottom width 353B. In some embodiments, the right pad 150A may include a substantially straight front edge 354A and a curved a back edge 354B. In some embodiments, the left pad 150B may define a mirror image of the right pad 150A.

Each of the pads 150A-150C may include any suitable pad material, such as an open cell foam, a closed cell foam, a memory foam, a gel, or an any combination thereof. In some embodiments, one or more of the pads 150A-150C may be formed of or include a memory foam material to assist in defining and/or maintaining the body engagement shape 351 and/or the firearm engagement shape 352. In some embodiments, one or more of the pads 150A-150C may include a heat formable plastic material. In such embodiments, the pad may be placed in a warming oven to soften the pad material. Upon removal from the oven, the pad may be formed into a desired shape, where upon cooling, the pad retains the desired shape.

In some implementations, each of the pads 150A-150C may be provided in a number of different configurations. The different configurations may include different thicknesses, different shapes, different levels of firmness, different padding materials, or different flexibilities in bending including bending in different directions, for example. In some embodiments, the different configurations may include shapes specifically formed to match or fit a defined firearm 10 or holster 20. As such, a user may choose a pad that is specifically tailored to the user's concealed carrying needs or preferences. For example, a user may choose a right pad 110A having a shape and a firmness specifically tailored to prevent pressure points or other irritation of the user's hip bone. By way of another example, a user may choose a groin pad 110A having a cup shape and structure specifically tailored to protect the user's groin anatomy from injury.

Each of the pouches 110A-110C includes an opening 312 through which the respective pad may be inserted and/or removed. In the illustrated embodiment, the opening 312 is located at the top of the pouch. In other embodiments, the opening 312 may be located along a side or at the bottom of the pouch. In some embodiments, the opening 312 may include a closure mechanism 313 to close the opening 312. The closure mechanism 313 may include any suitable mechanism, such as a single ended zipper, a double ended zipper, a snap, a button, a hook and loop fastening system, or an overlapping fabric flap, for example. The closure mechanism 313 for each of the pouches 110A-110C may be same or each of the pouches 110A-110C may include a different closure mechanism 313.

The left pad 150B is shown having a number of flexing features 355 configured to enhance a bendability of the left pad 150B. Although not shown, the right pad 150A and the groin pad 150C may also include flexing features similar to the flexing features 355. In some embodiments, it may be advantageous to enhance a flexibility in bending over what may typically be afforded by the pad material generally. In some instances, a pad that includes a compound curved shape may tend to resist bending. In the illustrated embodiment, the flexing features 355 includes a number of slits extending laterally across a portion of the width of the left pad 150B, where the slits define hinge-like portions of the left pad 150B. As may be appreciated by one of ordinary skill, the slits are only one exemplary form of flexing features 355 they may be incorporated into the pad to enhance the flexibility in bending. As such, any suitable alteration in the structure of the pad to enhance the flexibility in bending is included in this disclosure.

Figure 4:
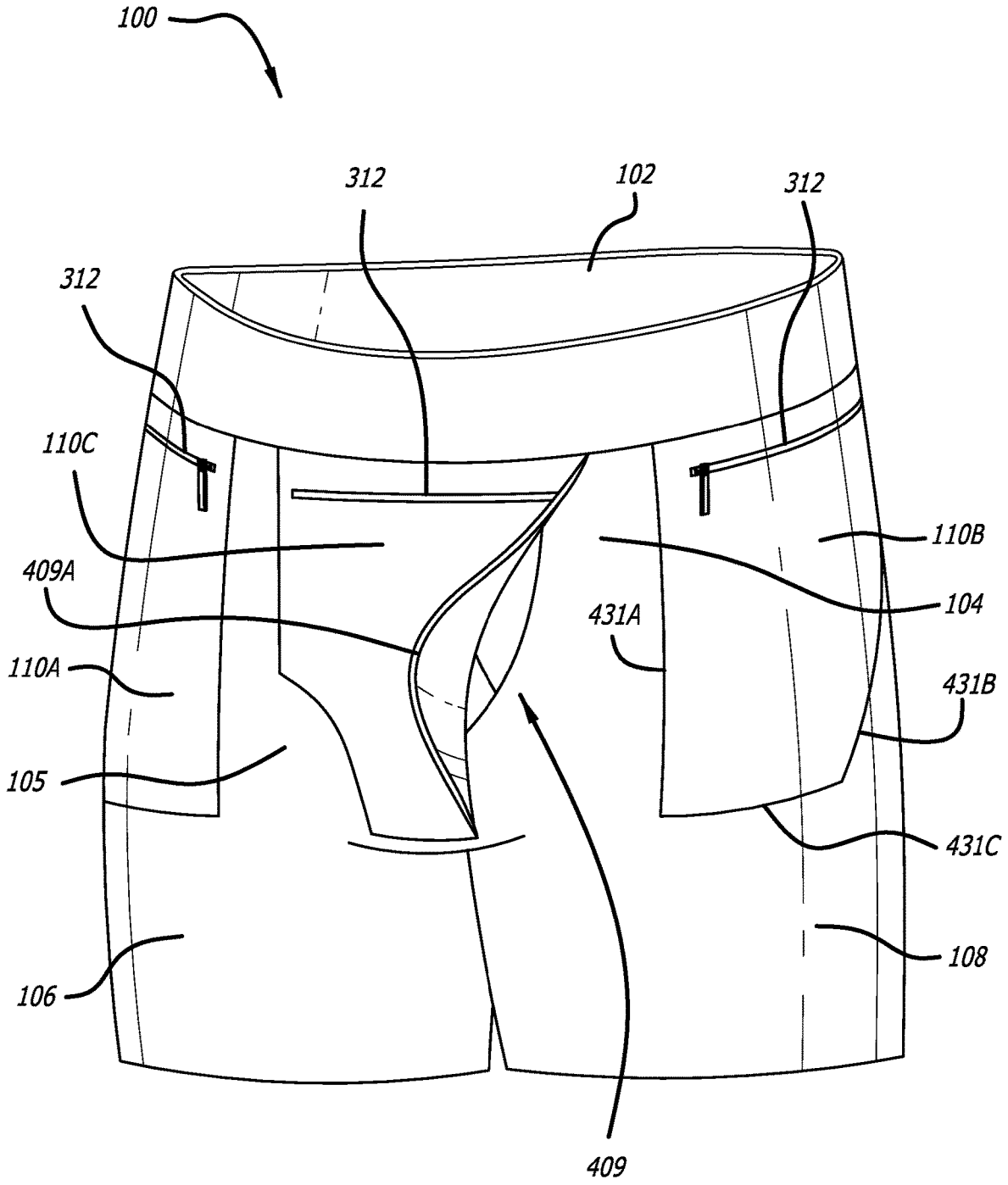
FIG. 4 is a front perspective view of the underwear of FIG. 1 illustrating additional components and features of the underwear, in accordance with some embodiments.

FIG. 4 is a front perspective view of the underwear 100 that further illustrates features and components of the underwear 100. Each of the pouches 110A-110C may be defined or formed by a sewn seam extending along the opposite edges of the pouch and along a bottom edge of the pouch, where the sewn seam attaches the first fabric layer 221 to the second fabric layer 222. For example, the left side pouch 110B includes (i) a sewn seam 431A extending along a front edge of the left side pouch 110B, (ii) a sewn seam 431B extending along a back edge of the left side pouch 110B, and (iii) a sewn seam 431C extending along a bottom edge of the left side pouch 110B. In some embodiments, the sewn seam 431A defines a substantially straight front edge of the left side pouch 110B, and the sewn seam 431B defines a curved back edge of the left side pouch 110B. In some embodiments, the shape of the left side pouch 110B matches or is similar to the shape of the left pad 150B. It is noted that the description above regarding the left side pouch 110B may apply equally well to the right side pouch 110A and the groin pouch 110C. As such, each of the right side pouch 110A and the groin pouch 110C may include sewn seems similar to the sewn seams 431A-431C of the left side pouch 110B. As may be appreciated by one of ordinary skill, defining the pouches via sewn seams coupling the first fabric layer 221 with the second fabric layer 222 is only one exemplary method of forming the pouches. As such, any suitable method of defining the pouches, such as coupling a preformed pouch to the first fabric layer 221, for example, is included in this disclosure.

The underwear 100 may include a fly opening 409 to facilitate urination. In some embodiments, the fly opening 409 may include an overlapping fabric flap 409A, and in some embodiments, the overlapping fabric flap 409A may include a portion of the groin pouch 110C. In some embodiments, the fly opening 409 may be omitted.

The underwear 100 may enable a method of carrying a firearm at a concealed location on a person, where the method may include all or a subset of the following steps or processes which in some embodiments may be performed by the user. A step may include choosing a placement location on his person for carrying a firearm. In some embodiments, the choosing step may include choosing more than one placement location on his person for carrying more than one firearm. In some embodiments, the placement location is chosen from three potential placement locations for carrying the firearm at a concealed location.

Another step may include placing a pad within a pouch of the underwear, where the pouch is positioned adjacent the placement location so as to provide comfort to the user. The step may include placing more than one pad within the pouch to provide an added measure of comfort or protection to the user.

Another step may include choosing a pad for placement in the pouch from a number of optional pads, where the optional pads include different configurations, such as thickness, firmness, shape, or material, for example. In some embodiments, the pad includes a shape defined in accordance with the placement location. The shape may be different from shapes defined in accordance with the other concealment locations. In some embodiments, the pouch includes a shape that matches the shape of the pad so that the pad position is secured by the pouch. The shape of the pad may include a curved shape defined in accordance with a body anatomy.

Another step may include donning the underwear so that the pad within the pouch is located adjacent the placement location. Another step may include securing the firearm adjacent the pouch. At the conclusion of the method, the user may carry the firearm without experiencing discomfort, irritation, or injury from the firearm.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. An underwear for use with carrying a concealed firearm, comprising:
- one or more fabric layers defining:
  - a hip portion, the hip portion including a right side and a left side,
  - a waistband disposed at a top of the hip portion,
  - a right legging and a left legging extending downward from the hip portion, and
  - a groin area extending across a front side of the hip portion;
- a right side pouch extending across the right side;
- a left side pouch extending across the left side;
- a groin pouch extending across the groin area, wherein each of the right side pouch, the left side, and the groin pouch are configured for placement of a pad therein; and
- a first pad configured for placement in any of the right side pouch, the left side pouch, or the groin pouch, wherein the first pad includes a depression having a shape of either a firearm or a holster.

2. The underwear of claim 1, wherein each of the right side, left side, and groin pouches are formed by an outside fabric layer coupled with an inside fabric layer via a sewn seam defining a perimeter extending along a bottom edge and opposite side edges of each of the right side, left side, and groin pouches.

3. The underwear of claim 1, wherein the perimeter of each of the right side and left side pouches includes a straight front side edge and curved back side edge.

4. The underwear of claim 1, wherein a top side of one or more of the right side, left side, and groin pouches includes a closure mechanism having one or more of a single ended zipper, a double ended zipper, a hook and loop fastening system, a button, a snap, or an overlapping fabric layer.

5. The underwear of claim 1, further comprising:
- a right pad configured for placement within the right side pouch,
- a left pad configured for placement within the left side pouch, and
- a groin pad configured for placement within the groin pouch.

6. The underwear of claim 5, wherein, during use, the underwear includes at least one of:
- the right pad disposed within the right side pouch,
- the left pad disposed within the left side pouch, or
- the groin pad disposed within the groin pouch.

7. The underwear of claim 5, wherein, during use, the underwear includes at least one of:
- more than one right pad disposed within the right side pouch,
- more than one left pad disposed within the left side pouch, or
- more than one groin pad disposed within the groin pouch.

8. The underwear of claim 5, wherein, during use, the underwear includes at least two of:
- the right pad disposed within the right side pouch,
- the left pad disposed within the left side pouch, or
- the groin pad disposed within the groin pouch.

9. The underwear of claim 5, wherein each of the right pad, the left pad, and the groin pad are flexible in bending so that the right pad, left pad, or groin pad bend in accordance with motion of the user.

10. The underwear of claim 5, wherein one or more of the right pad, the left pad, or the groin pad include a preformed body engagement shape to correspond to an anatomy of the user.

11. The underwear of claim 1, wherein the depression does not form a hole through the first pad.

12. The underwear of claim 5, wherein the right and left pads are mirror images of each other.

13. The underwear of claim 5, wherein one or more of the right pad, the left pad, or the groin pad include a memory foam.

14. The underwear of claim 1, the one or more fabric layers include:
- an interior fabric layer composed of a moisture wicking material, and
- an exterior fabric layer composed of an abrasion resistant material.

15. An underwear for use with carrying a concealed firearm, comprising:
- one or more fabric layers defining:
  - a hip portion, the hip portion including a right side and a left side,
  - a waistband disposed at a top of the hip portion, a right legging and a left legging extending downward from the hip portion, and a groin area extending across a front side of the hip portion;

a first pouch extending across one of the groin area, the left side or the right side, wherein the first pouch is configured for placement of a pad therein; and a first pad configured for placement in the first pouch, wherein the first pad includes a depression having a shape of either a firearm or a holster.

* * * * *